US006666138B2

(12) United States Patent
Randazzo

(10) Patent No.: US 6,666,138 B2
(45) **Date of Patent: *Dec. 23, 2003**

(54) SHOCK ABSORBER CUSHION AND METHOD OF USE

(76) Inventor: Jeffrey A. Randazzo, 7211 Pimlico La., Parkland, FL (US) 33076

( * ) Notice: Subject to any disclaimer, the term of this patent is extended or adjusted under 35 U.S.C. 154(b) by 0 days.

This patent is subject to a terminal disclaimer.

(21) Appl. No.: 09/883,878

(22) Filed: Jun. 18, 2001

(65) Prior Publication Data

US 2001/0042471 A1 Nov. 22, 2001

Related U.S. Application Data

(63) Continuation-in-part of application No. 09/334,847, filed on Jun. 16, 1999, now Pat. No. 6,247,403.

(51) Int. Cl.[7] ..... B41F 27/00

(52) U.S. Cl. ..... 101/379; 101/395; 101/401; 101/376

(58) Field of Search ..... 101/401.1, 211, 101/395, 401, 375, 376, 402, 379

(56) References Cited

U.S. PATENT DOCUMENTS

| | | | | |
|---|---|---|---|---|
| 3,425,347 A | | 2/1969 | Nard | |
| 3,599,306 A | | 8/1971 | Brafford | |
| 3,903,794 A | | 9/1975 | Grupe et al. | |
| 4,323,637 A | * | 4/1982 | Chen et al. | 430/271.1 |
| 4,375,971 A | | 3/1983 | Moll | |
| 4,381,961 A | | 5/1983 | van der Velden | |
| 4,685,393 A | | 8/1987 | Saueressig | |
| 4,880,501 A | * | 11/1989 | Schiel | 100/121 |
| 4,894,315 A | * | 1/1990 | Feinberg et al. | 430/281.1 |
| 5,553,806 A | | 9/1996 | Lucas | |
| 5,704,291 A | | 1/1998 | Lewis | |
| 5,752,444 A | | 5/1998 | Lorig | |
| 5,894,799 A | | 4/1999 | Bart et al. | |
| 6,247,403 B1 | | 6/2001 | Randazzo | |

* cited by examiner

*Primary Examiner*—Andrew H. Hirshfeld
*Assistant Examiner*—Jill Culler
(74) *Attorney, Agent, or Firm*—Malin, Haley & DiMaggio, P.A.

(57) ABSTRACT

A sheet of elastomeric material that serves as a shock absorber and cushion for use between a printing plate, such as but not limited to a flexographic printing plate, and a printing cylinder during printing for compensating for variations in thickness, height and centricity of the printing cylinder and printing plate to prevent distortions in the image being printed that includes providing an elastomeric material having a longitudinal direction in the direction of circumferential travel of the cylinder circumference that includes a plurality or array of protrusions formed of the elastomeric material of predetermined cross-sectional shape and area and the material having a durometer to cushion the printing plate in such a way to provide the necessary compensation to ensure a high quality printed image at high speed. The cross-sectional shapes and the array of the longitudinal protrusions provide for the material's lateral displacement zones that allows the elastomeric material to be displaced and return relatively instantaneously to its original height or near original height to obtain and maintain high quality printing, thereby compensating for tolerance errors between the drum size and the flexographic plate thickness.

20 Claims, 6 Drawing Sheets

SHOCK ABSORBER CUSHION AND METHOD OF USE

This application is a continuation-in part of U.S. patent application Ser. No. 09/334,847, filed Jun. 16, 1999.

BACKGROUND OF THE INVENTION

1. Technical Field of the Invention

This invention relates to a shock absorber and cushion for use during printing that compensates for variations in thickness, height and centricity of the materials and equipment used for printing to enhance the image quality and efficiency of the printing process without increasing printing pressure.

2. Description of Background Art

Flexography is a printing process used primarily in the packaging and newspaper industries. The flexographic and letterpress printing process requires that a raised surface plate be used to transfer ink onto a given substrate. This is unlike lithography, which uses a flat image carrier (plate) where non-print areas are aluminum and areas to print on are lacquer, based on the principle that oil and water do not mix. The gravure printing process is a recess process in which cells are engraved into the print cylinder that are then filled with ink and then transferred to the substrate.

Letterpress is similar to flexography utilizing a raised image carrier and also requiring a cushioning layer. Letterpress equipment is available as a platum or cylindrical plate mounting apparatus.

The flexographic printing process' unique capabilities include changing cylinder dimension (circumference) to accommodate various length packaging. Printing presses in flexography can be as narrow as six inches or less and in excess of 120 inches wide. As in most manufacturing and machine processes, there is a plus or minus tolerance in gauge (thickness) uniformity which may include: the print cylinder uniformity, both across and around the web; a tolerance in the material surface being printing on; and, the tolerance of the back cylinder which the substrate rides on as it maneuvers through the press in addition to other mechanical elements. Variations in tolerances require excessive pressure during printing on the flexographic plate to overcome inaccuracies, which may smear and distort the print image such as halos and oval dots.

Currently the raised imaged carriers (flexographic plates) adhere to a print cylinder using various methods, which include clamps, pins, vacuum and most commonly, an adhesive tape applied to a flat seamless cylinder. There are various types of adhesive tapes used to adhere the flexographic printing plate to the cylinder. Although there are many variations of adhesive tape materials available, the materials used are routinely lumped into the following three categories:

(1) Hard Tape—no significant or claimed cushioning affect. This tape is best used when large amounts of ink need to be applied at 100% strength (full strength). However, since this tape has no inherent ability to even out the mechanical tolerances of the printing press, more than minimal pressure is normally required. This pressure creates a distorted printed image appearing in various forms that may include hard edges around the outer portion of the line copy while leaving a halo adjacent to this hard edge. Depending upon impression required, text may be squeezed to a point where it begins to slur (elongated the print in a through-press direction).

(2) Soft Tape—used as a cushion to allow even impression across and around the cylinder. This is because soft foam tape collapses or compresses under pressure in the areas that come into impression first which represent the largest circumference of the print package and must be impressed several thousands more until the entire image appears to be printing evenly and uniformly. Because of its softness, this material is used primarily when fine details or extremely small images are printed to help minimize the distortion that occurs under pressure with hard tape. Soft tape is traditionally used when printing half tones for screened pictorials, gradations and screen tints. Due to the soft nature of this cushioning element, the amount of pressure required to transfer a solid image is significantly compromised.

(3) Medium tape used as a cushioning element considered being of medium density. Medium tape is a compromise between the attributes of a soft tape used for printing fine graphics, and, hard tape used for images which need to print robust solids on the same printing surface using the same cushioning material.

The present invention eliminates or minimizes the negative attributes of the cushion product(s) described above available today. This includes inconsistency in gauge of the raw material currently available which is said to vary by plus or minus several thousands of an inch. With foam technology, foam cells or voids are filled with air, and during impression, under high spots, air is forced away and needs time to return to cells and thus return to initial tape height or dimension prior to the next revolution of the press. Cell inflation delay requires the press to run at lower speeds when working with a foam material, soft or medium. The slower drum speeds provide the time for the foam cell tape material to rebound between successive impressions. Throughout a very long print run, the foam material gradually loses ability to rebound. Constant monitoring is required throughout the run and most often results in color shifts and unacceptable print at some point in time, which is normally over one million impressions—but in most cases not greater than three million impressions.

U.S. Pat. No. 3,285,799 discloses a printing blanket for long periods of use in offset lithography, which is composed of a polymeric film and woven backing, an ink transfer layer, and a resilient compressible support layer. The support layer has an external surface subdivided by grooves that leaves flat surfaced islands. The blanket is used as an intermediate to transfer an ink image from a printing plate to paper. The support layer has a durometer of at least 60 Shore A. The support layer contains at least about 0.005 cubic inches of voids per square inch of blanket surface but total void volume does not exceed 40%.

U.S. Pat. No. 5,325,776 discloses a cushioning backing sheet material positioned between a flexographic printing cylinder and a flexible printing plate. The cushioning sheet is an elastomeric material containing widely spaced, closed cell voids which provide pockets within which the encapsulated air can be pneumatically compressed when force is applied, and which all rebound rapidly when the force is relieved. A disadvantage of the closed-cell cushioning material fatigues and looses compression and resilience qualities, and thus print quality deteriorates.

BRIEF SUMMARY OF THE INVENTION

A shock absorbent cushion design for transforming a body of displaceable material to react under pressure as if it was compressed thereby creating a cushioning effect. Controlled displacement is created by virtue of the design and the depth in a manner not to cause a rise before or after the nip point in the displacement of said material which would normally occur without the design of the present invention.

Generally, the present invention is a shock absorber and cushion for use directly or indirectly under virtually any type of printing plate or offset blanket in order to compensate for variations in thickness, height and centricity of the printing cylinder and printing plate during the printing process. The invention includes a sheet of elastomeric material sized to be placed around the printing plate cylinder, blanket cylinder, sleeve, or platum, said elastomeric sheet having predisposed displacement zones resulting from creating voids within the elastomeric material of predetermined thickness providing a path of least resistance for the displacement material for maintaining an even impression along the printing plate both across and around the printing plate cylinder.

The sheet of elastomeric material includes a predetermined geometric pattern that define the displacement zones which are preferably, although not limited to, circumferential in direction, i.e. linear raised protrusions that, in the preferred embodiment, extend in the direction of the printing path and that can be in parallel rows, spaced apart, circumferentially around the printing cylinder and in the direction of the printing drum rotation. The elastomeric sheet in accordance with the present invention has a plurality or an array of spaced-apart zone displacements of a predetermined geometrical cross-sectional shape and size, that may be evenly or randomly spaced apart and which are preferably in a parallel array in the direction of the rotation of the printing cylinder (substantially circumferential) relative to the printing cylinder. The spaced-apart displacement zones allow the elastomeric material to be radially displaced into the adjacent displacement zone to accommodate variations in thickness, height and centricity of both the printing plate and the print cylinder to which it is mounted.

In the preferred embodiment, the protrusions are linearly disposed. However, the linearity of the protrusions could vary and still provide the necessary radial displacement. The geometric pattern is designed to deliver varying amounts and levels of displacement or compression resistance thus controlling the impression required for fine graphics, while providing the resilience and modulus necessary to print large solids. Virtually any geometric orientation of protrusions may provide the necessary displacement zone. By way of example only, the geometric shapes shown in the accompanying drawings will provide the necessary displacement zone. The displacement zone is a combined product of the geometric cross-sectional area and shape itself and is greatly influenced by the distance placed between these protrusion elements as well as the durometer, resilience modulus and volume of the elastomeric material.

It is important that any geometric orientation of protrusions run (with or without break) in-press direction around the print cylinder. The press direction is described as the direction the printed material travels through the press. However, it is within the spirit of the invention to provide an orientation of protrusions which maintain the same cushioning and displacement characteristics, yet do not run in truly "in-press" direction, but are situated in a substantially oblique relationship with respect to the direction of cylinder rotation.

In the preferred embodiment, the cushioning element is compromised of two layers: one is the base layer which consists of any stable layer of flexible material such as paper or cellophane, or any dimensionally stable layer of flexible material such as any metallic, polyester or vinyl material, or MYLAR™. This material is used as a stabilizing base for the second layer which contains the geometric protrusion array all made of the same elastomeric material of a predetermined durometer whose resilience at normal operating temperatures will deform and fill the adjacent displacement areas under various amounts of stress. The cross-sectional shape of each protrusion strip may be a trapezoid, by way of example. The strips, spaced uniformly or randomly apart, are spaced apart at a predetermined distance and disposed across or around the cylinder width. Suitable elastomeric materials include, but are not limited to, polybutadience, polyisoprene, polychloroprene; and olefin copolymers such as styrene-butadiene copolymers, natural or synthetic rubbers (e.g. acrylonitrile-butadiene copolymer), ethylene-propylene copolymer, butyl rubber and foam rubber (e.g., isobutylene-isoprene copolymer). Elastomers which are thermoplastic are also suitable as the cushion layer and include, but are not limited to, styrene-diene-styrene triblock copolymers, such as polystyrene-polybutadiene-polystyrene (SBS), polystyrene-polyisoprene-polystyrene (SIS, or polystyrene-poly (ethylenebutylene)-polystyrene (SEBS); thermoplastic polyester and polyurethane elastomers; fluoroelastomers and thermoplastic polyolefin rubbers (polyolefin blends). Suitable elastomers also include chlorosulfonated polyethylene, polysulfide, polyalkylene oxides, polyphosphazenes, elastomeric polymers and copolymers of acrylates and methacrylates, and elastomeric copolymers of vinyl acetate and its partially hydrogenated derivatives.

In an alternate embodiment, the geometric protrusions themselves could be made of two or more layers of materials of different durometers, resilience or modulus to further efficiently control the resistance. The required resistance may vary and be altered to respond to the various print market such as corrugated, newsprint, poly/plastic and paper which may require different resistances. Being able to control these individual factors, a wide range of refinements for various cushioning requirements are possible. These protrusions from top to base formed from the elastomeric material should be greater than 5% of the total volume from floor to ceiling and should not exceed 95%. The most preferable ratio is between 10% and 50% volume of material to displacement void. The area adjacent the protrusion material mass shall be considered displacement void zones. The embodiment of this displaceable protrusion material is currently created by using photopolymer plate material from various manufacturers including but not limited to Dupont's "Cyrel®", Polyfiberons' "Epic®" and BASF's "NyloFlex®" photopolymerizable, photocrosslinkable or both. The photopolymerizable layer compromises an elastomeric binder, at least one monomer and an initiator, where the initiator is preferably a photoinitiator having sensitivity to actinic radiation. Any photopolymerizable compositions which are suitable for the formation of flexographic printing plates can be used for the present invention. Examples of suitable compositions have been disclosed, for example, in Chen et al, U.S. Pat. No. 4,323,637, Gruetzmacher et al, U.S. Pat. No. 4,427,749 and Feinbert et al., U.S. Pat. No. 4,894,315.

The processes available to manufacture the cushion include laser engraving, mechanical engraving, molding, vulcanizing, embossing, extruding and other current technologies.

The cushion is mounted between the plate cylinder surface and the printing plate base. The cushion may be glued to the cylinder surface and to the printing plate surface. Alternatively, sticky tape may be used to attach the cushion with adhesive to the cylinder surface and also to the printing plate surface.

The cushion may be mounted so that the protrusions engage the bottom of the printing plate or conversely such that the protrusions engage the surface of the plate cylinder. In the preferred embodiment, the protrusions would engage the plate cylinder surface and be essentially inverted relative to the plate surface. Whether upside down or right-side up, depending on the point of view, it is important that the protrusion strips, in the preferred embodiment, be disposed to run parallel or in the direction of the circumferential drum rotation. The cushion material could also be used with any other printing plate mounting system that may include vacuum, clamps, sleeves, pins or other mechanical attachment.

The cushion described herein may be placed on a cylinder or sleeve sized to fit the outer diameter of the cylinder on which the plate is directly mounted. An alternative is to mount the printing plate on a second sleeve designed to fit over the initial sleeve or cylinder that the cushion layer is attached to.

The cushion, in accordance with the present invention, can be mounted onto the plate cylinder with adhesive, glue or double-sided adhesive tape. Thus, the cushion is directly against the printing plate, or indirectly, if you consider that glue or adhesive tape holds the cushion to the cylinder and to the printing plate.

In alternate embodiments, the support base and/or the protrusions could be added during the manufacturing process on the back of the printing plate so that it becomes part of the printing plate itself. In that case, the cushion and plate would be together as one single entity and then would be mounted by adhesive or other fastener onto the print cylinder. It is also in another embodiment possible that the plate cylinder surface itself could include permanently a particular cushion. And yet another possible alternate embodiment would be that the cushion, during the manufacture or finish, become a permanent part of the cylinder of sleeve.

It is an object of this invention to provide an improved cushion or shock absorber for use in a printing process to compensate for variations in thickness, height and centricity of the materials and equipment used in flexographic and other types of printing to enhance image quality and efficiency without increasing printing pressure which distorts the ultimate printed image.

It is another object of this invention to provide a cushion between a printing plate and printing drum that retains its resiliency without fatigue over extremely long printing runs without reducing image quality.

In accordance with these and other objects which will become apparent hereinafter, the instant invention will now be described with particular reference to the accompanying drawings.

DESCRIPTION OF THE PREFERRED EMBODIMENTS

Figure 1:
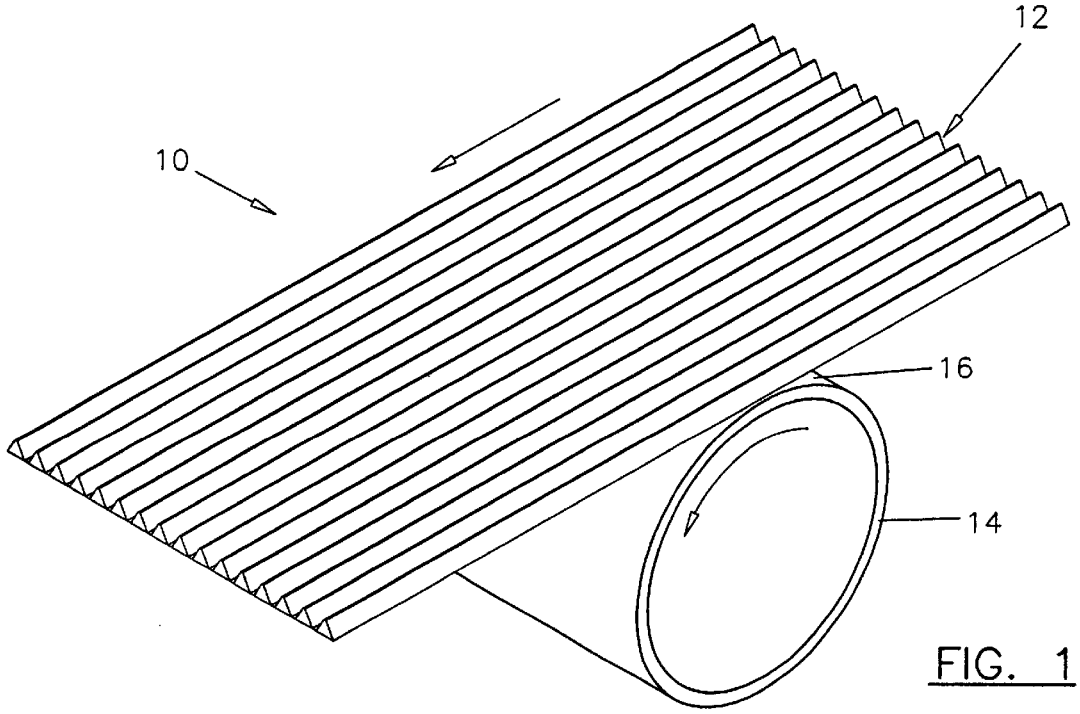
FIG. 1 shows a perspective view of an elastomeric sheet disposed adjacent a plate cylinder in accordance with the present invention. The sheet shown in FIG. 1 is to be wrapped around the outside of the cylinder, which represents the plate cylinder.

Referring now to the drawings, and in particular FIG. 1, the present invention, which is used as a shock absorber or cushion, is shown generally at 10 comprised of a sheet of elastomeric material 12 that is shown positioned above a plate cylinder 14 having a surface 16 that is used with a flexographic or other type of printing plate, (not shown in FIG. 1) for printing. In the operating position, the elastomeric sheet 12 is shown to be disposed around the circumference of cylinder 14 and may be glued or otherwise fixed to the cylindrical surface 16 around the drum. A double-sided sticky back adhesive sheet can be employed to affix the cushion to the drum. The arrow shows the direction of the drum rotation and in the preferred embodiment, the direction of the elastomeric sheet 12 in operation. In the preferred embodiment, the protrusion strips engage the drum surface.

A printing plate used for printing is affixed (glued) on top of cushion 12. Therefore, the elastomeric sheet 12 acts as a shock absorber or cushion between the drum surface and the printing plate which is attached by glue on top of the cushion 12.

Once the plate and cushion 12 are installed, the printing process would then proceed as normal. If the cylinder 14 has tolerance errors in diameter or if the thickness of the plate vary from the ideal norm, the cushion 12 allows for compressive displacement to allow equal pressure on the plate during its operation of printing so that the final printing does not have flaws (bright/dark spots or slur). Because of the compressive displacement of the cushion 12, excessive printing pressure on the plate is not necessary that would otherwise distort the image forming elements.

Figure 2:
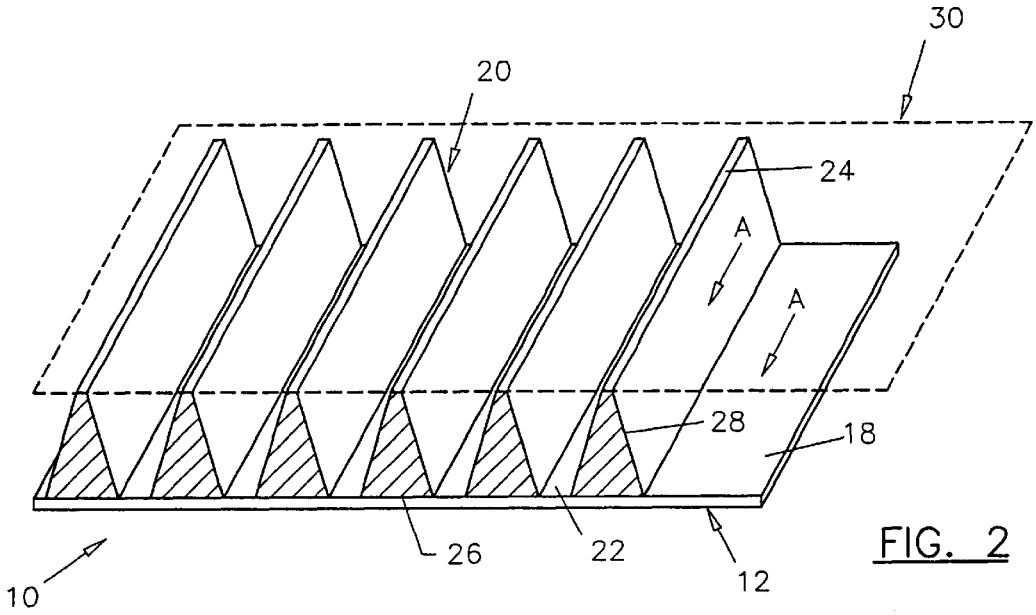
FIG. 2 shows a perspective view, partially in cross-section and cut-away, of a section of the elastomeric sheet shown in FIG. 1.

Referring now to FIG. 2, the elastomeric sheet 12 is shown (partially cut away as a segment) that is preferably comprised of a polyester support base 18 that has a plurality of trapezoidally-shaped (in cross-section) elastomeric protrusions 20 which are attached to base 18 and are essentially parallel strips in a parallel array and spaced apart by a predetermined distance as shown by area 22 that separates adjacent protrusions 20.

Each trapezoidally-shaped protrusion 20 includes a small flat top surface 24 that is parallel to the top surface of support base 18, a pair of converging sidewalls 28 that converge to the top wall 24 and a bottom wall 26 affixed to base 18.

The cushion 12 is comprised of a cushion layer of elastomeric material forming protrusions 20 and the MYLAR support base 18. The total volume of material occupied by each protrusion 20 and one adjacent void whose base is shown as surface 22 define a displacement zone which allow for vertical compression or displacement of each protrusion area into adjacent void space between the protrusions. When looking at a cross-section perpendicular to the movement of cushion 12 defined by arrow A along the drum surface, the cross-section across the width of the cushion shows the trapezoidal-shaped faces of the protrusion and a likewise trapezoidally-spaced void between protrusions. The dimensions of each protrusion, including the width of the top, the converging sidewalls, the base 26 and the displacement adjacent space which includes surface 22 and diverging walls between adjacent protrusions and the distance between the tops of adjacent protrusions are varied to control firmness and to meet a predetermined relationship displacement zone of 5%–95%. Therefore, the area of the trapezoid forming a protrusion 20 would be range from approximately 5%–95% of the area occupied by protrusion. The cross-sectional shape of each protrusion can be varied and is discussed in greater detail below. An alternative is that the protrusions may have some lateral displacement such as a zigzag or s-shaped strip with deviations, for example, less than 45° may be tolerated relative to the straight line direction of travel indicated by arrow A.

The protrusions 20 are formed from a sheet of photopolymer material using known technology and can be of different geometric configurations as discussed below. The displacement necessary to be an effective shock absorber is figured by the pressure where a printing plate 30, such as a flexographic printing plate, as it rests on the top wall 24 of each of the protrusions, would be compressed by variations and errors in the centricity of the drum or the variations in the thickness of the plate 30 during operation or during the printing process itself.

The purpose of the invention is to allow sufficient displacement between the drum and the plate 30 that the elastomeric material, and in particular the protrusions 20, can be compressed or deformed downwardly and also return to their static position without wear or stress. The shape in cross-section, which would be perpendicular to the direction of arrow A as shown, of each protrusion 20, the specific dimensions of the base, the top, the sidewalls, and the spacing between protrusions along the base and the top wall, are factors in determining the amount of ultimate displacement therefore controlled resistance that occurs between the cylinder 14 and especially the drum surface 16, as shown in FIG. 1, and a plate 30, as shown in FIG. 2.

In the preferred embodiment, it is important that the protrusions 20 have a longitudinal access in the direction of arrow A, which is also the circumferential direction of the drum movement during the printing operation. Under low stress at room temperature, the elastomeric protrusions will return to its original or near original height or gauge for extended printing runs.

Figure 3:
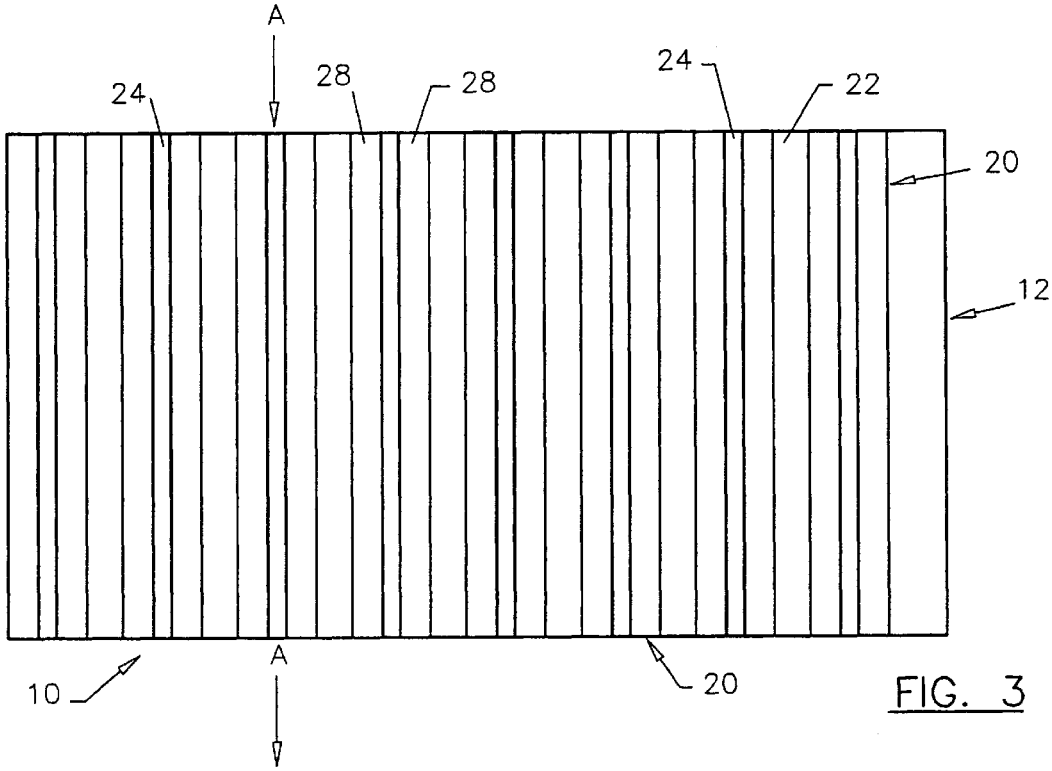
FIG. 3 shows a top plan view of the segment shown in FIG. 2.

FIG. 3 shows a top plan view of the elastomeric sheet 12 and the spacing 22 between adjacent protrusions 20. Also shown in FIG. 3 is the width of the top wall of protrusion 20 and how they are parallel to each other and, preferably, spaced uniformly in strips across the entire width of cushion 12. Arrow A represents the direction of travel so that the cushion 12, as shown in FIG. 3, would actually be wrapped around the drum with the protrusions 20 oriented in the direction of rotation of the drum circumferentially and in the direction of arrow A. Therefore, the width of the sheet 12 would constitute and be determined by the width of the print drum or plate. The printing drums do vary in size and width and in diameter, and the cushion would be manufactured in sufficient lengths and widths to accommodate drums of different diameters and widths. Because of the elastomeric properties of the chosen material, the spacing 22 between each protrusion helps define the total displacement area available as well as the resistance and resilience.

Figure 4:
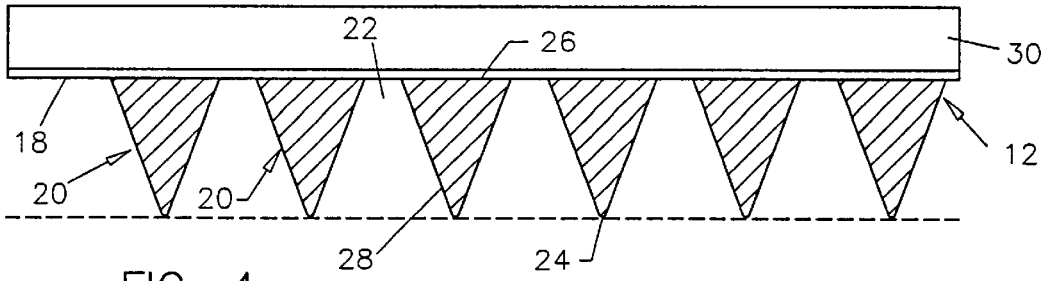
FIG. 4 shows a cross-sectional view schematically of the elastomeric sheet shown in FIGS. 2 and 3.

FIG. 4, for illustrative purposes only, shows the relationship between protrusions 20, which are in an adjacent parallel array. Each protrusion 20 includes a top surface 24, a base 26 wider than the top 24 and the spacing 22 along the base 18. In operation, a plate 30 is glued to the polyester support base 18 and the drum surface is glued against each of the top walls 24 of all of the protrusions 20. The sheet 12 may be inverted in operation such that the polyester base 18 is attached against the drum surface.

Figure 5:
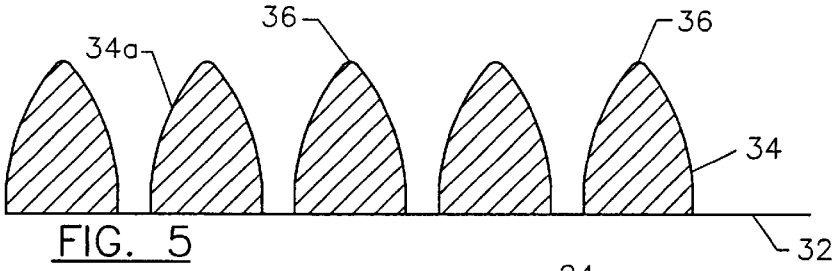
FIG. 5 shows an elevational cross-sectional view of an alternate embodiment of the present invention showing different elements of the geometric shape as well as adjacent displacement areas.

In an alternate embodiment, the cross-sectional shape of the protrusions could be varied to something like shown in FIG. 5, which is a modified trapezoid that includes sidewalls 34 and 34A that converge along the top wall 36. Again, a printing plate 30, such as shown in FIG. 4, could rest along the top wall surfaces 36 in each of these protrusions so that displacement would be a downward compression between the plate 30 and a drum that would be along the bottom surface of 32 or the cushion could be inverted as discussed above.

Print cylinders vary in both width and circumference. The circumferential range of print cylinders is available in circumferences from less than 6 inches to over 40 inches. Dimensions of print cylinders change circumferentially based on the package repeat or length. Flexography uses a raised plate of varying thickness, ranging from 0.03 inches or less to greater than 0.255 inches. In the prior art, the adhesive/foam tape that was available came in different thickness and when the print cylinder or sleeves are ordered, the overall height of elements adhere to the cylinder plate or attached by a sleeve must be a known and consistent overall height. The tolerance for this variation is known as "cylinder undercut". One of the purposes of this invention is to provide an overall buildup of elements adhered to a print cylinder that add up exactly toward the proper undercut. Therefore, if in an example, a plate were 0.067 inches and the blanket were 0.020 inches, the undercut would be 0.087 inches. With the present invention, the plate would be 0.045 inches and an adhesive plate to blanket would be 0.005 inches while the blanket itself would be 0.030 inches and the adhesive blanket to the cylinder would be 0.005 inches. This would result in an undercut of 0.085 inches.

In accordance with this invention, there is a direct relationship between the elastomeric material durometer, the shape of the protrusion or displaced element, the materials height, shape and area of displacement. Most tests to-date have involved wide-web presses thirty (30) inches and wider printing on plastic or paper. A change in protrusion height, geometric shape of the elements, the durometer of each elastomeric layer or layers of displacement material in addition to changes in the displacement zone may be further modified which would be determined by each market segment, namely the print medium and printing process.

The characteristics in accordance with this invention were tested with displacement protrusions that were in straight lines ranging in widths of 0.001 inches to approximately 0.3 inches. The second characteristic of the pattern used is the spacing between protrusions. The present invention in experiment realized various levels that were successful when the void space was at least equal to the materials' surface image with spaces as great as ten times the image width. In accordance with this example, the most preferable image top width was 0.004 inches while maintaining a space between images of approximately 0.042 inches. This creates an image support that, at its most narrow point, was 0.004 inches in expanding in width from the top of the cushion to the polyester base approximately 0.021 inches.

It is important that regardless of the geometrical cross-sectional shape that the protrusion element run, preferably without a break, in the circumferential direction around the print cylinder, that is the press direction. The press direction is described as the direction the printed material travels through the press. The importance of putting this geometrical shape in the press direction creates the path of most resistance for displacement around the cylinder, forcing the displacement across the cylinder in such a way as to not distort the printed image. Small breaks in the protrusion strip element in the circumferential direction may be desirable for specific configurations.

Figure 6:
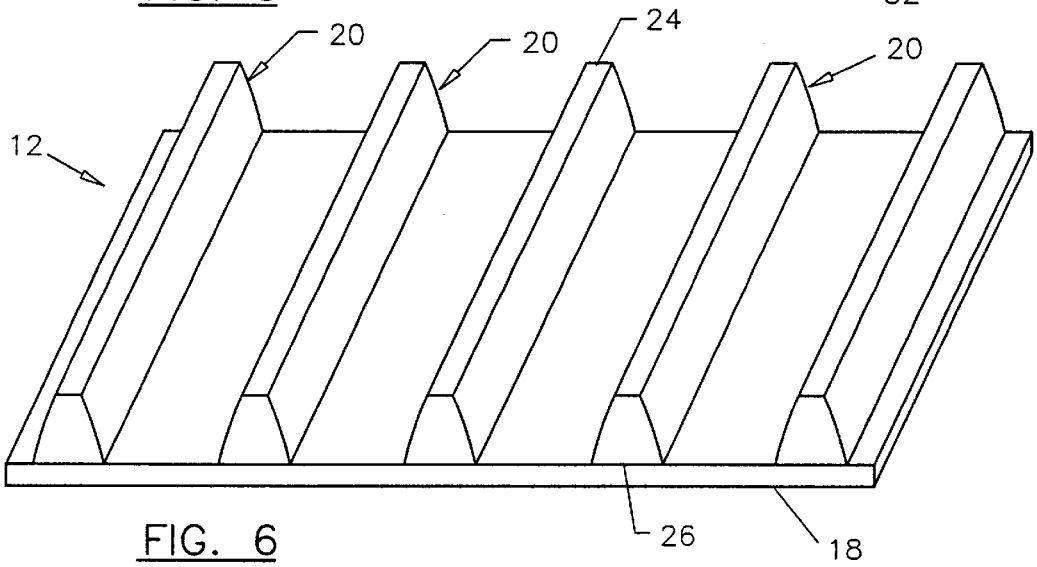
FIG. 6 shows a prospective view of one embodiment of the invention.

Referring to FIG. 6, the cushion or shock absorber 12 is comprised of two layers. The first layer 18 is a dimensionally stable support base layer of polyester, metal, fabric, composite, paper, film or alternate flexible material or polymeric film material, which is dimensionally stable provided that one requires dimensional stability. The first layer 18 is used as a stabilizing base for the elastomeric material second layer 20, which contains the elastomeric material and the plurality in array of circumferential protrusions whose resilience at normal operating temperatures will deform and fill the adjacent displacement areas under various amounts of compression or stress. They elastomeric protrusions return relatively instantly and rapidly to the original or near original dimension when the compression pressure is removed. The second layer 20, which is the elastomeric material, can be comprised of multiple layers with different durometer, resilience, resistance and modulus.

The protrusions in cross-sectional areas formed from the elastomeric material should be greater than five percent (5%) of the total cross-sectional area from top 24 to the base 26 and should not exceed ninety-five percent (95%). The most preferable ratio is between ten and thirty percent (10%–30%). The area comprising the rest of the material mass shall be considered displacement zones or voids.

Figure 7:
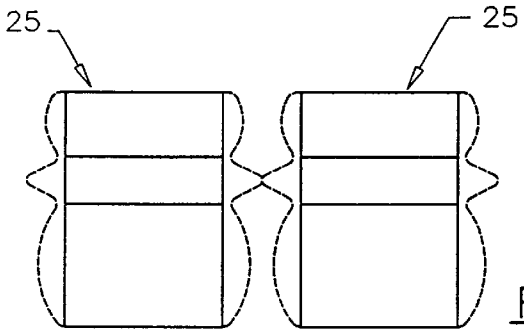
FIG. 7 shows a schematic diagram of an alternate embodiment of the invention using different durometers and different hardness in an elevation in cross-section. The dotted lines represent the compression distortion and resistance when the element is compressed downwardly.

FIG. 7 shows a pair of protrusions 25 as an example that has, from top to bottom, different layers of material of different durometers which would be used to control the effect of cushion resilience. The multi-layers of varying durometer would thus control initial displacement zone and the effective overall cushion resilience. The dotted line show the proposed displacement from a vertical or top down compression caused by tolerance errors in the printing equipment as discussed above. Thus, it can show that each area would have a different displacement, but the sum total would be at some desired total displacement.

Figure 8A:
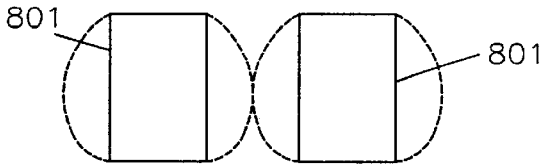
FIGS. 8A through 8M show pairs of cushion elements represented schematically as the cross-sectional shape of adjacent protrusions with the dotted lines representing areas of geometric displacement zone when the elements are compressed downwardly due to variations in the printing process to be corrected.

Referring now to FIGS. 8A–8M, a plurality of different cross-sectional representative shapes for the protrusion strips are shown schematically that represent the possible cross-section of the protrusions as they are attached to the polyester sheet. The compression displacement expected is shown as dotted lines indicating displacement of adjacent protrusions in operation. In FIG. 8A, rectangles 801 are shown and the dotted portions are shown curved due to downward compression on these elements.

Figure 8B:
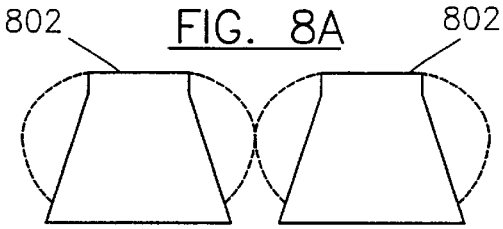

In FIG. 8B, trapezoids 802 are shown that displace as they compress (as shown dotted), and they may contact each other adding additional resistance.

Figure 8C:
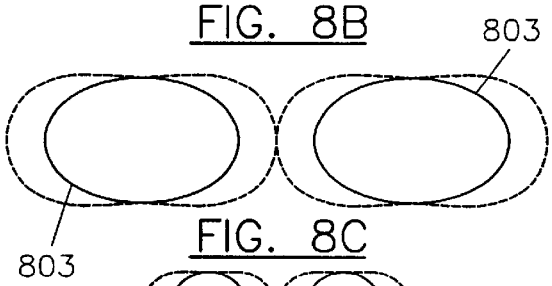

FIG. 8C shows a pair of ovals 803 that can expand sideways (as shown dotted) for the displacement from top down.

Figure 8D:
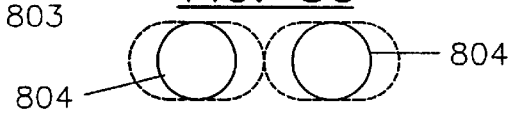

FIG. 8D shows a pair of circular protrusion elements 804 that can displace (as shown dotted).

Figure 8E:
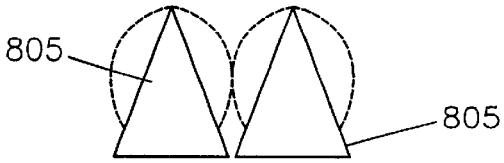

FIG. 8E shows a pair of isosceles triangles 805 spaced apart and the anticipated displacement (as shown dotted).

Figure 8F:
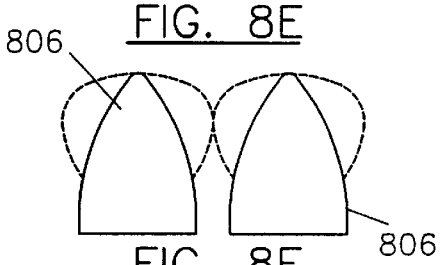

FIG. 8F shows a pair of protrusions 806 having a flat top portion somewhat arcuate sidewalls that can expand (as shown dotted).

Figure 8G:
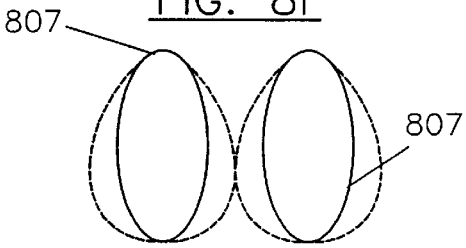

FIG. 8G shows elliptical protrusions 807 or oval shape protrusions with their longer access being vertical and disposed adjacent each other (as shown dotted) showing the displacement.

Figure 8H:
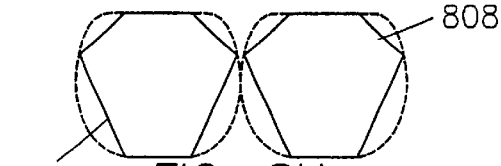

FIG. 8H shows six-sided figures with shorter edges at the top than the bottom, which are polygons 808, which would be next to each other (as shown dotted).

Figure 8I:
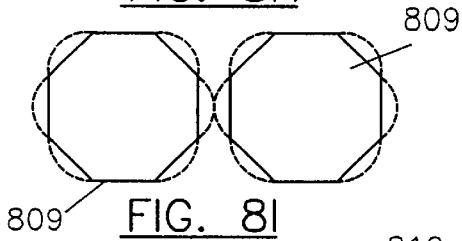

FIG. 8I shows octagons 809 and the resulting displacement as shown dotted.

Figure 8J:
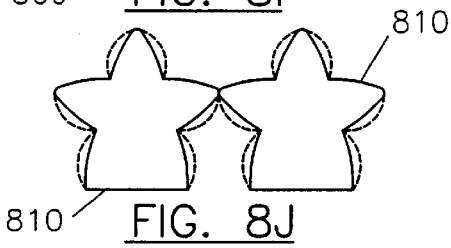

FIG. 8J shows protrusion elements 810 that are star shaped in the top portion and the displacement expected as shown dotted.

Figure 8K:
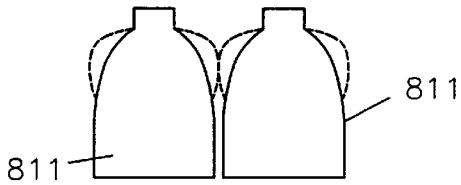

FIG. 8K shows somewhat arcuate protrusions 811 with flat tops on them placed adjacent each other with the dotted lines showing compression displacement.

Figure 8L:
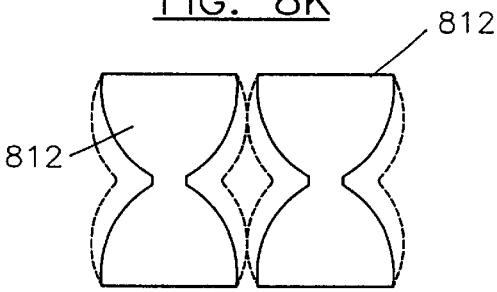

FIG. 8L shows two somewhat circular cross-sectional units 812 joined end-to-end, from top to bottom, and the dotted lines show the anticipated displacement during compression.

Figure 8M:
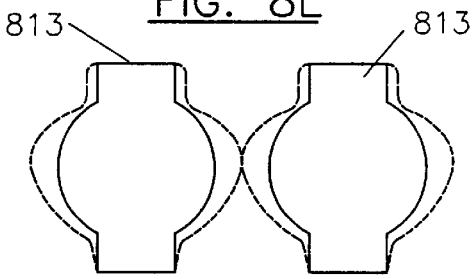

FIG. 8M shows circular center bodies 813 with rectangular tops and bottoms for protrusions, and the dotted lines show the anticipated compression.

Referring back to FIG. 6, the preferred embodiment of the invention is shown to provide specific dimensions such as approximately 0.063 inches from center-to-center of each adjacent protrusion with the base of each protrusion being approximately being 0.021 inches in width at its base, and the spacing between protrusions along the base portion be approximately 0.042 inches. The dimensionally stable carrier 18 is 0.007 inches. The top wall 24 is 0.004 inches approximately.

In summary, controlling the displacement longitudinally along the direction of the print drum travel with a continuous, or almost continuous, element in a parallel array has been found to greatly improve the shock-absorbing characteristics between the printing plate and the drum. In doing this, it greatly increase the accuracy and clarity of the printed material with longer runs because the material does not have to be replaced as often as the prior tape used for this purpose before. Variations will be possible in the geometric shape, the durometer and geometric configurations to vary the resilience, compression and displacement based on a particular type of job and material or print medium required.

In the preferred embodiment, the shock absorber of the present invention is generally comprised of stable layer of flexible material such as paper or cellophane. In an alternate embodiment the support base is comprised of a dimensionally stable layer of flexible material such as any polyester material or metallic material, or MYLAR®.

It is within the scope of the present invention to provide a shock-absorbing cushion wherein the protrusions are comprised of a plurality of layered materials, each layer having a different durometer, resilience or modulus than each other layer. Conversely, the each layer may be comprised of the same durometer, resilience or modulus.

The protrusions themselves can be comprised of a different durometer, resilience or modulus or the same durometer, resilience or modulus.

The shock absorber described herein can be manufactured for various applications and in many thicknesses. In the preferred embodiment, on material whose protrusions are less than 0.020 in height, there should be little or no elastomeric material between the protrusions and the support base is exposed between the protrusions. In the instance where the process requires the protrusions to be 0.020 inches or taller, it may be desirable to increase the overall thickness of the support base by attaching a foundation layer to the support base, under and/or on either side of the protrusions.

In one embodiment, the protrusions are photographically imaged from a solid sheet of material and subsequently processed, thereby separating the unexposed material from the exposed material leaving the protrusions having a desired geometric shape.

In an alternate embodiment the shock absorber is adapted to be manufactured on or adhered to the back of the printing plate so that the shock absorber becomes integral with the printing plate. The shock absorber is adaptable to be manufactured as a layer of a sleeve or of the cylinder and becomes an intricate part of the cylinder or sleeve on which the printing plate is attached by various methods. Further, the protrusions could be created from a mold and adapted to adhere to the support base.

The foundation layer may be of the same or a different durometer than the support base. In either case, between the protrusions, the foundation layer covers the support base. Therefore, in the instance when the height of the protrusions are 0.020 inches or greater, the support base is preferably not exposed between protrusions.

Figure 9A:
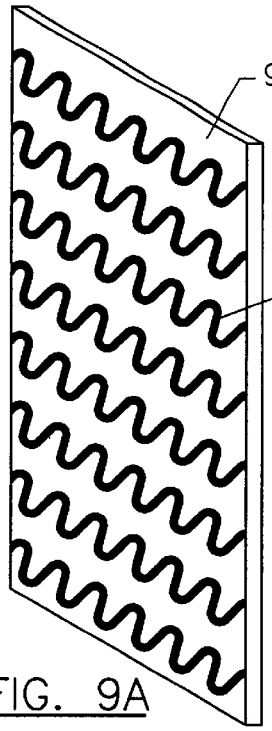
FIGS. 9A through 9G illustrate top views of further protrusion arrangements in a variety of configurations.
Figure 9B:
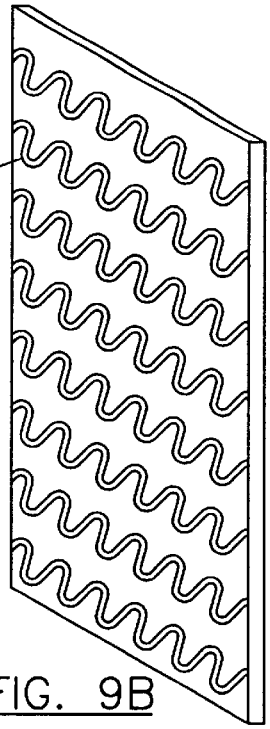
Figure 9C:
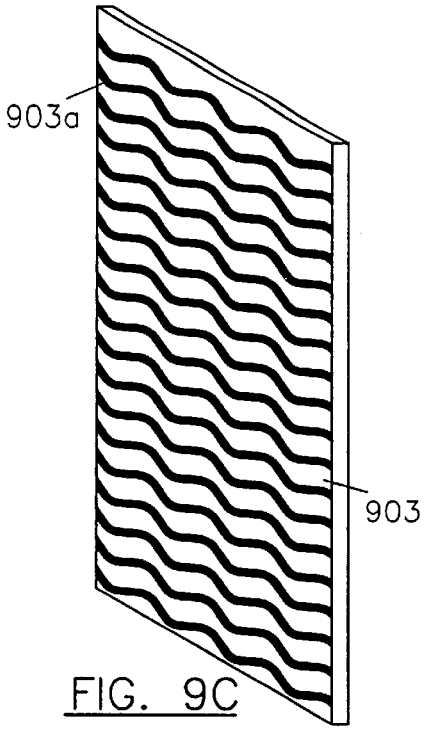
Figure 9D:
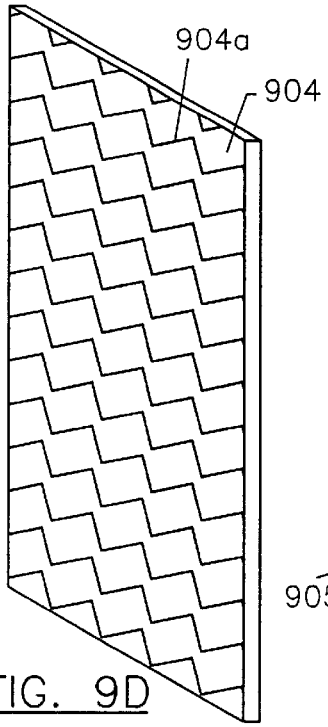
Figure 9E:
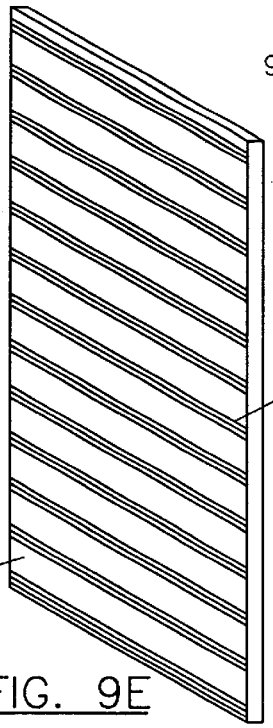
Figure 9F:
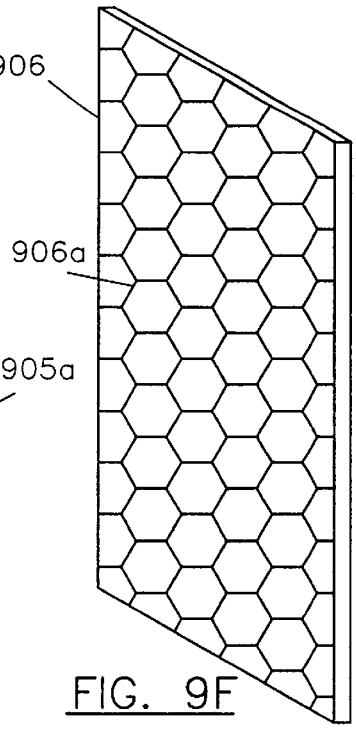
Figure 9G:
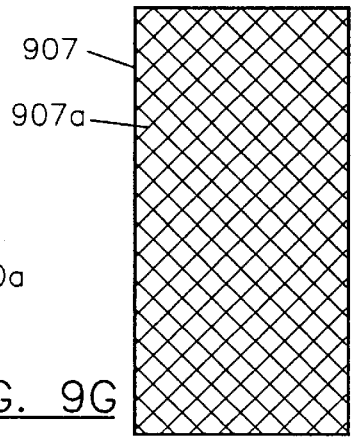

In FIGS. 9A–9G, top down views of alternate configurations of protrusions are shown. These patterns provide the necessary shock absorbing characteristics (a) with or without a base layer, (b) with the voids between the protrusions being free from any elastomeric material, (c) having a base layer of the same or similar elastomeric material as the protrusions, (d) with a second structure as a base layer, such as polyester or a flexible material with a higher durometer, (e) with a support layer on both the top and bottom of the protrusions creating shock absorption not only through the controlled displacement but also by the air volume trapped between the upper and lower base layer in between the profiles. Referring now to FIG. 9A protrusions 901 are represented as being separated by groves 901*a* in a wavy fashion. FIG. 9B shows raised wavy protrusions 902. FIG. 9C shows protrusions 903 that are somewhat wavy separated by somewhat wavy groves 903*a*. FIG. 9D shows zigzag protrusions 904 separated by a space 904*a*. FIG. 911 shows a twin protrusion 905*a* separated by spaces 905. FIG. 9F shows protrusions 906 that are basically hexagons separated by spaces 906*a*. FIG. 9G shows a plurality of protrusions 907 that are diamond shaped separated by spacing 907*a*. FIGS. 9A through 9G represent pictorially different types of spaced apart protrusions that might be implemented in practicing the present invention and are shown in a graphical manner only.

Figure 10:
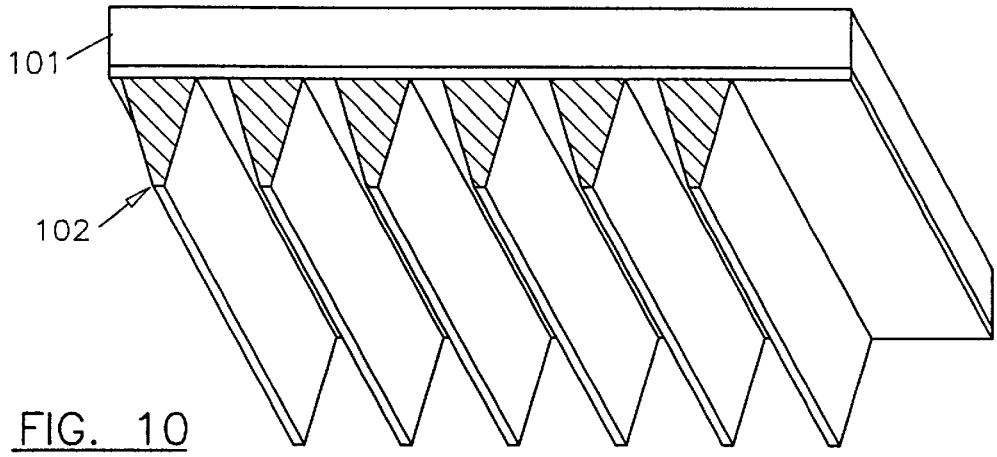
FIGS. 10 and 11 illustrate a cross sectional view of the shock absorber of the present invention layer within a lithographic (offset) printing blanket.
Figure 11:
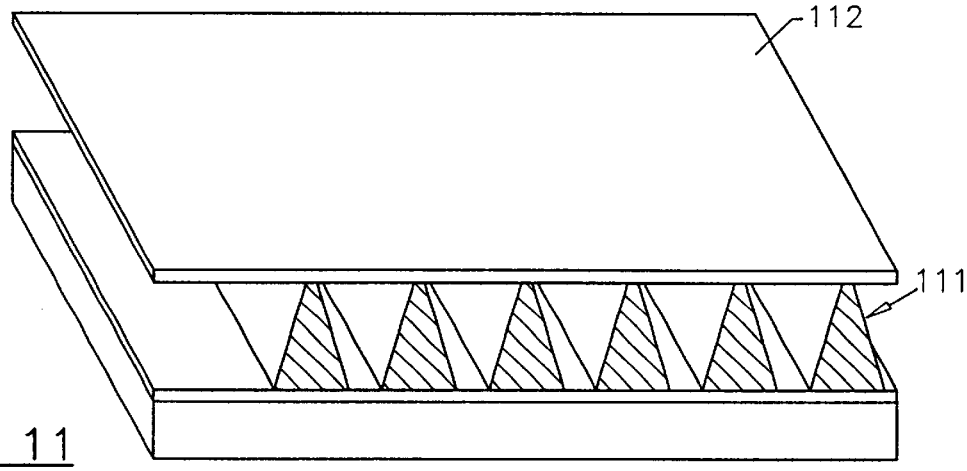

The shock absorber of the present invention can be applied to the lithographic or offset printing industry. FIG. 10 illustrates an offset blanket which typically uses multiple layers of fabric and/or foam with different durometer rubber material to achieve compression. However, the foam, fabric or other material used to create the ability to compress, fatigue over time and lose their resilience. FIG. 10 shows the displacement technology with protrusions 102 used under the rubber image transfer surface 101 (attached or unattached) of an offset lithographic blanket. FIG. 11 shows the displacement layer 111 as a layer in the make-up of a blanket 112.

Figure 12:
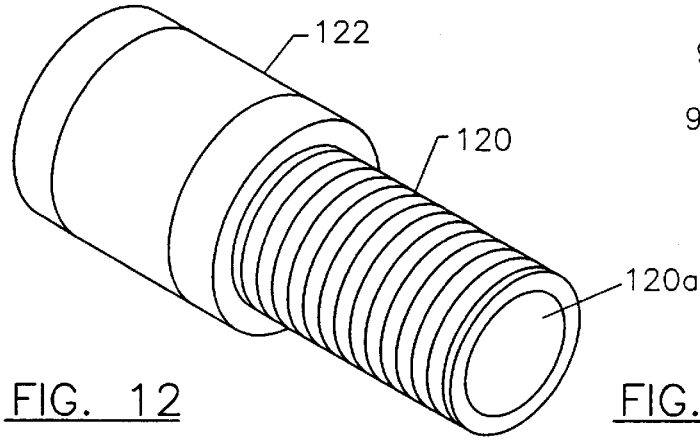
FIG. 12 illustrates an alternate embodiment of the present invention utilizing multiple sleeves where the cushion is attached to one of the inner sleeves.

FIG. 12 represents yet another application of the present invention. Here, the shock absorbent cushion 120 of the present invention is placed around a sleeve sized to fit around the outer circumference of the cylinder 120*a*. The printing plate (not shown) is therefore not mounted directly on top of the cushion. The printing plate here is mounted on a second sleeve 122 designed to fit over the initial sleeve or cylinder 120*a* that the 120 cushion is attached to.

Although the primary application of the above-described apparatus and process is in the printing industry, including flexographic, letterpress and lithographic (offset) printing, the shock absorber described herein can apply to any industry where it is desirable for a design to transform a body of displaceable material to react under pressure as if it was compressing, thereby creating a cushion effect. In effect, controlled displacement of the material is created by virtue of the design profile of the present invention.

The shock absorbent cushion could be adapted to be used where compression is desired but displacement is not. In this embodiment, an elastomeric body attaches to the surface of a substantially cylindrical, platum or rotatable first body. The elastomeric body is made of a predetermined durometer and comprised of a support base and a plurality of raised protrusions formed of said elastomeric material.

The protrusions have a predetermined height and cross-sectional shape and are spaced apart a predetermined distance such that a compression between the surface of a second body and the surface of the first body on the elastomeric body will result in a predetermined displacement of the protrusions to compensate for variations in the first body surface.

Each protrusion is continuous along and has substantially the same length as the support base. Each protrusion is also adapted to be continuous around the substantially cylindrical first body in the first body's rotational direction thereby leaving the path of least resistance lateral to the side of the geometric shape of each protrusion during compression.

The instant invention has been shown and described herein in what is considered to be the most practical and preferred embodiment. It should be recognized, however, by the quantity of examples and uses, that many departures and variations may be made therefrom within the scope of the invention and that obvious modifications will occur to a person skilled in the art.

What is claimed is:

1. A shock absorber for use in a printing process where compression is desired but displacement is not, situated between a printing plate and a plate cylinder surface to compensate for variations in thickness, height, and centricity of the cylinder and plate, the shock absorber comprising:

an elastomeric body constructed of an elastomeric material for attachment to the surface of a plate cylinder;

said elastomeric body being made of a predetermined durometer;

said elastomeric body including a support base having a top surface and a plurality of raised protrusions formed of said elastomeric material;

said protrusions each having a predetermined height to fit between a printing plate and plate cylinder during printing and a predetermined cross-sectional shape and spaced apart a predetermined distance forming a void between adjacent protrusions such that a compression between the printing plate and the plate cylinder surface on said elastomeric body will result in a predetermined displacement of said protrusions to compensate for variations in the plate cylinder and plate operation to improve printing quality; and each said protrusion being continuous along said support base, and having substantially the same length as said support base, each said protrusion surrounding and being continuous around said cylinder leaving the path of least resistance lateral to the side of the geometric shape of each protrusion during compression.

2. The shock absorber as in claim 1 wherein each said protrusion is continuous around said cylinder in the cylinder's rotational direction.

3. The shock absorber as in claim 1, wherein said voids between said continuous protrusions of said elastomeric material constitute displacement zones of a predetermined cross-sectional area and volume providing desired resilient response to pressure applied between said plate cylinder and said plate on said elastomeric body.

4. The shock absorber as in claim 1, wherein said elastomeric body includes a plurality of raised protrusions, each protrusion separated by a void between adjacent protrusions a protrusion displacement cross-sectional area between 5 percent to 95 percent relative to the total cross-sectional area of each protrusion plus an adjacent void area.

5. The shock absorber as in claim 1, including:

said elastomeric body including an array of raised protrusions are continuous in length around the cylinder in the print direction leaving the path of least resistance lateral to the side of the geometric shape of each protrusion during compression.

6. The shock absorber as in claim 1, wherein each said protrusion includes:

a substantially flat top surface substantially parallel to the top surface of said support base;

a pair of tapered sidewalls converging at said protrusion top surface; and a protrusion bottom surface.

7. The shock absorber in claim 1, wherein said support base is comprised of a dimensionally stable layer of flexible elastomeric material.

8. The shock absorber in claim 7, wherein said dimensionally stable layer of flexible material is any polyester material.

9. The shock absorber in claim 7, wherein said dimensionally stable layer of flexible material is any metallic material.

10. The shock absorber in claim 1, wherein each said protrusion is comprised of the same durometer, resilience or modulus.

11. The shock absorber of claim 1, wherein said shock absorber is adapted to be manufactured on or adhered to the back of said printing plate so that said shock absorber becomes integral with said printing plate.

12. The shock absorber of claim 1, wherein said shock absorber is adaptable to be manufactured as a layer of a sleeve or on said cylinder and becomes an intricate part of said cylinder.

13. The shock absorber of claim 1, wherein said protrusions and said support base are both extruded from a single piece of said elastomeric material.

14. The shock absorber of claim 1, wherein said support base is exposed between said protrusions when said protrusions are less than 0.020 inches in height.

15. The shock absorber of claim 1, said height of said raised protrusions being 0.020 inches or greater, an additional foundation layer to increase overall thickness covering said support base under and/or surrounding the protrusions, for preventing the support base from being exposed between said protrusions and altering the characteristics of said shock absorber.

16. The shock absorber of claim 15, wherein said foundation layer has the same durometer as said attached support base.

17. The shock absorber of claim 15, wherein said foundation layer has a different durometer then than said attached support base.

18. A shock absorber for use in a printing process where compression is desired but displacement is not, situated between a printing plate and a plate cylinder surface to compensate for variations in thickness, height, and centricity of the cylinder and plate, the shock absorber comprising:

an elastomeric body constructed of an elastomeric material for attachment to the surface of a plate cylinder;

said elastomeric body being made of a predetermined durometer;

said elastomeric body including a support base having a top surface and a plurality of raised protrusions formed of said elastomeric material;

said protrusions each having a predetermined height to fit between a printing plate and plate cylinder during printing and cross-sectional shape and spaced apart a predetermined distance forming a void between adjacent protrusions such that a compression between the printing plate and the plate cylinder surface on said elastomeric body will result in a predetermined displacement of said protrusions to compensate for variations in the plate cylinder and plate operation to improve printing quality; and each said protrusion being continuous along said support base, and having substantially the same length as said support base, each said protrusion surrounding and being continuous around said cylinder leaving the path of least resistance lateral to the side of the geometric shape of each protrusion during compression; and wherein said protrusions are comprised of a plurality of layered materials, each of a different durometer, resilience or modulus.

19. A shock absorber for use in a printing process where compression is desired but displacement is not, situated between a printing plate and a plate cylinder surface to compensate for variations in thickness, height and centricity of the cylinder and plate, the shock absorber comprising:

an elastomeric body constructed of an elastomeric material for attachment to the surface of a plate cylinder;

said elastomeric body being made of a predetermined durometer;

said elastomeric body including a support base having a top surface and a plurality of raised protrusions formed of said elastomeric material;

said protrusions having a predetermined height and cross-sectional shape and spaced apart a predetermined distance such that a compression between the printing plate and the plate cylinder surface on said elastomeric body will result in a predetermined displacement of said protrusions to compensate for variations in the plate cylinder and plate operation to improve printing quality;

each said protrusion being continuous along said support base, and having substantially the same length as said support base, each said protrusion surrounding and being continuous around said cylinder leaving the path of least resistance lateral to the side of the geometric shape of each protrusion during compression; and each said protusion is comprised of a different durometer, resilience or modulus.

20. A method of enhancing the image quality and efficiency of a printing process employing a plate cylinder and a printing plate to compensate for height and centricity errors without substantially increasing printing pressure comprising the steps of:

providing a printing plate cylinder and an elastomeric body for attachment to the surface of a plate cylinder, said elastomeric body being made of a predetermined durometer, said elastomeric body including a support base and a plurality of raised protrusions formed of said elastomeric material, said protrusions having a predetermined height to fit between said plate cylinder and a printing plate during printing and a predetermined cross-sectional shape longitudinally disposed in the rotational direction of the plate cylinder and spaced apart a predetermined distance such that a compression between said printing plate and the plate cylinder surface on said elastomeric body resulting in a predetermined displacement of said protrusions to compensate for variations in the plate cylinder and plate operation to improve printing quality, each said protrusion being continuous along said support base, and having substantially the same length as said support base, each said protrusion surrounding and being continuous around the plate cylinder in the plate cylinder's rotational direction leaving the path of least resistance lateral to the side of the geometric shape of each protrusion during compression.

* * * * *